US006575325B2

(12) United States Patent
Dickie et al.

(10) Patent No.: US 6,575,325 B2
(45) Date of Patent: Jun. 10, 2003

(54) ARTICULATED PULL TAB OPENER FOR CONTAINER

(76) Inventors: Robert G. Dickie, 15 Valley Trail, Newmarket, Ontario (CA), L3Y 4V8; Bruce Gitelman, 111 Sandringham Drive, Toronto, Ontario (CA), M3H 1E2

( * ) Notice: Subject to any disclaimer, the term of this patent is extended or adjusted under 35 U.S.C. 154(b) by 0 days.

(21) Appl. No.: 09/802,882

(22) Filed: Mar. 12, 2001

(65) Prior Publication Data

US 2002/0125251 A1 Sep. 12, 2002

(51) Int. Cl.[7] ..... B65D 17/34
(52) U.S. Cl. ..... 220/269; 220/906
(58) Field of Search ..... 220/269, 270, 220/906, 271–273

(56) References Cited

U.S. PATENT DOCUMENTS 3,221,924 A * 12/1965 Harvey et al. ..... 220/269
3,301,434 A 1/1967 Harvey et al.
3,796,344 A * 3/1974 De Phillips et al. ..... 220/269
4,207,991 A * 6/1980 Amabili ..... 220/269
4,276,993 A 7/1981 Hasegawa
4,674,649 A * 6/1987 Pavely ..... 220/269
5,248,053 A 9/1993 Lundgren
5,806,757 A * 9/1998 Per et al. ..... 220/269
5,947,316 A * 9/1999 Guillonnet ..... 220/269
6,026,971 A 2/2000 Lundgren
6,279,769 B1 * 8/2001 Duvander et al. ..... 220/269

OTHER PUBLICATIONS

Hosford et al., "The Aluminum Beverage Can", Scientific American, Sep. 1994.

* cited by examiner

*Primary Examiner*—Robin A. Hylton
(74) *Attorney, Agent, or Firm*—Marks & Clerk

(57) ABSTRACT

A pull tab opener for a container having a push-in or fully severable closure is articulated at a crease line behind the rivet connecting the tab to the container top surface. At least a pair of protrusions extends upwardly from the base of the tab so that, when the rear lever portion is pivoted about the crease line, the opposed front faces of the protrusions contact each other, and the elastic memory of the tab is overcome so that the tab is articulated into a bent condition. The tab may then be re-grasped for easy opening of the container, without having to initiate opening leverage of the tab using the fingernail.

20 Claims, 10 Drawing Sheets

ARTICULATED PULL TAB OPENER FOR CONTAINER

FIELD OF THE INVENTION

This invention relates to containers and pull tab openers therefor. In particular, this invention relates to pull tab openers for containers such as aluminum beverage cans and the like, which have a tab lever whereby lifting the tab lever forces a push-in closure in the top surface of the container inwardly, and thereby opens the container for access to the interior thereof. The present invention provides an articulated pull tab opener for containers such as beverage cans and the like.

BACKGROUND OF THE INVENTION

Containers having pull tab openers are generally aluminum beverage cans, but they may be other containers including some beverage cans that are made of metals or plastics, and containers that are supplied for other purposes such as dispensing various fluids in automobiles into the appropriate reservoir therefor.

However, the preponderant use of containers having pull tab openers is in the aluminum beverage can industry, particularly for such beverages as soft drinks and beer.

Indeed, an article by Hosford and Duncan entitled *The Aluminum Beverage Can*, published at pages 48 through 53 of *Scientific American* for September, 1994, discusses that the United States production of beer and soft drink containers, even at that time, was in the range of 300 million aluminum beverage cans per day, for an output of 100 billion beverage cans per year. Each one of the those beverage cans has a pull tab opener; and each one of those pull tab openers is attached to the top surface or lid of the beverage can by a rivet which is formed integrally with the lid. At the side of the rivet opposite the outer end of the pull tab is a scored opening which is a push-in closure. The closure seals the can, and withstands the pressure therein until such time as it is forced downwardly at its frangible perimeter—typically, in the range of about 300° defining the push-in closure.

Over the years, the aluminum beverage can has become a very highly engineered product. As at 1994, the weight of an average beverage can had been reduced to about 0.48 oz. Great effort has been directed to reducing the mass of the can by thinning its walls, such that in 1994 it was estimated that a reduction of the mass of an average aluminum beverage can by even 1% would save approximately 20 million dollars per year (in 1994 dollars) in aluminum.

Through all of this time, however, there has been very little effort to improve the opening pull tab design. Typically, the pull tab is secured against the top surface or lid of the beverage can in an orientation which is essentially flat against and parallel to the top surface. The push-in closure is opened by lifting the outer end of the tab and pulling upwards so as to pivot the tab about the rivet. This tends to deform the lid of the surface of the can somewhat, but because of the dimensions involved, that deformation is not permanent except where the push-in closure has been broken away at its frangible outline and has been pushed or levered downwardly into the interior of the can so as to depend at an angle downwardly from the lid of the can.

This has meant that, typically, as many as 100 billion fingernails are at risk every year of being broken, while attempting to start the leverage action of the pull tab upwardly from its rest position against the top surface or lid of the beverage can. However, such circumstances continue to run almost unabated since the first aluminum beverage cans came into the market in 1958.

The present invention seeks to overcome that difficulty, by providing an articulated pull tab opener design by which individuals who have long fingernails, or weak fingers, or delicate hands, can still effect opening of the beverage can without difficulty and without risk to their fingernails or the tips of their fingers.

It must be kept in mind, however, that it is not possible to provide a pull tab which is such as to have a raised end that is present at the time that the pull tab is affixed to the lid of the beverage can. One particular reason for that is that the pull tab is rivetted to the lid of the beverage can prior to the top of the can being seamed to the body of the can in the region around the perimeter around the top of the can. Any pull tab which extends upwardly from the top surface of the can would get in the way of the seaming equipment. Of course, even with thousands of plants scattered about the country, it will be understood that each can must be filled and sealed in a minimum of time, and the provision of additional filling and seaming machines to accommodate a raised pull tab is not an option.

Further, an elevated pull tab may preclude stacking, it may get snagged by other cans during handling, and there is a risk that the score which defines the frangible edge of the push enclosure might get broken so as to cause leakage, lose pressure in the can, and so on.

The pull tabs which are provided for aluminum beverage cans are, themselves, highly engineered components. Typically, they are made with a progressive stamping dye from a thin coil of aluminum, and must stay in the punched metal strip until they are rivetted to the top of the can. Moreover, during leverage process to open the can by breaking the frangible seal and levering downwardly the push-in closure, the pull tabs must have considerable beam strength. Accordingly, pull tabs are typically formed with tubular cross-section perimeter, so that the high stress of opening the can will be withstood while, at the same time, permitting the use of thin coiled aluminum from which the pull tabs are manufactured.

Briefly, the present invention provides an articulated structure whereby the outer end of the pull tab—the end which is remote from the frangible push-in closure—can be articulated upward by being lifted to the extent that the elastic memory of the material of the pull tab is overcome, so that the outer end of the pull tab assumes a new rest position which is angled upwardly from the remaining portion of the tab in the region of the rivet. This arrangement is made possible by providing a crease line across the tab in a region behind the rivet, remote from the frangible push—in closure. At that point, the thickness of the tab is the thickness of the material from which it was made—or thinner, as described hereafter—so that it may be easily bent with a minimum of effort.

However, the present invention provides for a pair or pairs of protrusions which are formed such that, when the outer end of the pull tab is articulated upwardly, faces of the protrusions come into contact one with the other so as to provide force transmission and so as to preclude further bending or articulation of the outer end of the tab about the crease line.

Thus, the outer end of the lift tab opener may be easily tilted or bent upwardly to a new rest position, after which the end or the side of a finger may typically be placed underneath the tab, with the thumb being placed on the upper surface of the tab, so as to provide the appropriate leverage action to break the frangible seal and to lever the frangible push-in enclosure downwardly, in the manner which is well known.

DESCRIPTION OF THE PRIOR ART

Apart from the *Scientific American* article referred to above, several patents are known which teach various kinds of can openers which employ a levering lift tab construction.

HARVEY et al. U.S. Pat. No. 3,301,434 issued Jan. 31, 1967 teaches a can opener for a can. However, the opener is connected to the lid of the can in two different places, at two different rivets. One end of the opener forms a first lever which may be lifted from its end above a recess so that it will hinge upwardly around a hinge area and, at the same time, relieve or lift a first rivet away from the lid of the can so as to reveal a vent opening. Continued lifting of the opener causes the pre-scored area at the other end of the opener to break and hinge downwardly about a second rivet. The edges of the tab, except at the hinge area, are stiffened with a rib construction.

HASEGAWA U.S. Pat. No. 4,276,993 issued Jul. 7, 1981 teaches a non-detachable tab of the sort which is generally well known. A slight depression is provided underneath the end of the tab, but its purpose is to preclude a pair of projections which are provided on the tab from arcuate sideways motion. In other words, the purpose of the depression and the pair of projections is to inhibit rotation of the tab about the rivet by which it is fixed to the lid of the container. The tab is provided with an opening through which part of the forefinger can protrude, but the finger hole is small enough that the finger cannot come all the way through, and thereby pull the tab away from the can, and breakage of the fingernail is said to be precluded.

LUNDGREN U.S. Pat. No. 5,248,053 teaches an operating lever or tab for opening a beverage container, where the lever is rotated about the rivet and the end of the lever is elevated by being forced to run up a ramp being formed in the lid of the beverage container. However, this structure requires that the ramp be formed in the container lid, and the ramp may be in the way when a seaming operation occurs to close the can after it has been filled with its beverage. Moreover, use of the operating lever is not intuitive.

A similar arrangement in many ways is taught in LUNDGREN U.S. Pat. No. 6,026,971, issued Feb. 22, 2000. Once again, a ramp is built into the surface of the lid of the container, and once again the operating lever is rotated in most embodiments that are disclosed. The Lundgren lever operated opener requires a finger opening at its distal end. It provides a flexed portion of the tubular side arms of the operating lever and, in at least one embodiment, the material of the tubular portions of the side arms is formed downwardly to become a pair of flat surfaces on either side of the controlled flex portion. A control notch is provided also in the controlled flex portion, however, to promote flexing.

SUMMARY OF THE INVENTION

In accordance with one aspect of the present invention, there is provided a container and pull tab opener therefor. Typically, as noted, the container is an aluminum beverage container, but it is not necessarily an aluminum beverage container. In any event, the container has a top surface which has a frangible push-in closure therein, the frangible push-in closure being partially severable from the top surface. The pull tab opener is secured to the top surface at a place near the frangible push-in closure.

The pull tab opener comprises a nose portion and a tail portion. At least a portion of the nose portion overlies at least a portion of the frangible push-in closure; and the place where the pull tab opener is secured to the top surface is positioned between the nose portion and the tail portion.

The tail portion is articulable, and has a front lever portion which lies in the same plane and which is an extension of the nose portion, and it also has a rear lift lever portion which is articulably joined to the front lever portion at a crease line.

The tail portion comprises a base portion and at least a pair of protrusions upstanding from the base portion. One of the at least a pair of protrusions is located at each side of the crease line.

Each of the protrusions has a front face which is subtended by and extends upwardly from the crease line. Each of the front faces is rectangular in shape. Moreover, each of the front faces is opposed to the other of the front faces of the at least a pair of protrusions.

Each of the at least a pair of protrusions has a sloped rear surface extending downwardly from the top edge of the respective front face towards the base portion, in a direction away from the crease line.

The angle formed between the opposed pair of front faces is in the range of from 10° to 50°.

Typically, the pull tab opener is secured to the top surface by a rivet which is placed near the frangible-portion closure. In that case, the rivet is positioned between the nose portion and the tail portion.

Typically, two pairs of opposed protrusions are arranged, with one of each of the pairs of opposed protrusions being at each side of the crease line.

The perimeter of the pull tab opener is formed so as to have a tubular configuration, which extends above the base portion except in the region at each end of the crease line.

Two possibilities exist as to the height of the apex formed between the front face and the sloped rear surface of each of the at least a pair of protrusions, above the base portion. The height of the apex may be greater than the height of the tubular perimeter above the base portion, or it may be not greater than the height of the tubular perimeter above the base portion.

In a further embodiment of the present invention, the material of the base portion may be stamped in the region of the base line, so as to have a reduced thickness.

In another embodiment of the present invention, a depression may be formed in the top surface of the container in a region thereof which is below the tail portion. The crease line overlies the depression, and the length of the depression is less than the length of the tail portion.

The elastic memory of the material of the pull tab opener, in the region of the crease line, is such that when the rear lift lever portion is pivoted about the crease line so as to bring the opposed front faces of the at least a pair of protrusions into contact one with the other, the elastic memory is overcome. Thus, the rear lift lever portion is articulated to a new rest portion relative to the front lever portion.

This effect also may occur in those embodiments which include a depression in the top surface of the container. Thus, when the tail portion of the pull tab opener is pushed downwardly so as to permit the crease line to enter into the depression, and so that the rear lift lever portion is pivoted about the crease line to the extent that the opposed front faces of the at least a pair of protrusions are brought into contact one with another, then once again the elastic memory is overcome and the rear lift lever portion is articulated to a new rest portion relative to the front lever portion.

In another embodiment of the present invention, there is provided a container and pull tab opener therefor, where the container has a top surface which comprises a frangible lid which is fully severable away from the container, and where the pull tab opener is secured to the top surface near a portion of the frangible perimeter thereof.

The pull tab opener comprises a nose portion and a tail portion; and the nose portion is located in close proximity to the frangible perimeter of the lid. The pull tab opener is secured to the lid at a position on the pull tab opener which is between the nose portion and the tail portion.

The tail portion is articulable, and has a front lever portion which lies in the same plane and which is an extension of the nose portion, and it also has a rear lift lever portion which is articulably joined to the front lever portion at a crease line.

The tail portion comprises a base portion and at least a pair of protrusions upstanding from the base portion. One of the at least a pair of protrusions is located at each side of the crease line.

Each of the protrusions has a front face which is subtended by and extends upwardly from the crease line. Each of the front faces is rectangular in shape. Moreover, each of the front faces is opposed to the other of the front faces of the at least a pair of protrusions.

Each of the at least a pair of protrusions has a sloped rear surface extending downwardly from the top edge of the respective front face towards the base portion, in a direction away from the crease line.

The angle formed between the opposed pair of front faces is in the range of from 10° to 50°.

Other features of the embodiment of the invention wherein the entire lid is fully severable away from the container are as discussed above

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

The novel features which are believed to be characteristic of the present invention, as to its structure, organization, use and method of operation, together with further objectives and advantages thereof, will be better understood from the following discussion.

A first general embodiment of the present invention is shown in FIGS. 1 and 3 through 5. Particulars of the pull tab, which comprises an essential part of the present invention, are shown in FIG. 2. Another embodiment of the present invention, employing the same pull tab configuration but a different lid for the container, is shown in FIGS. 6 through 9.

Figure 1:
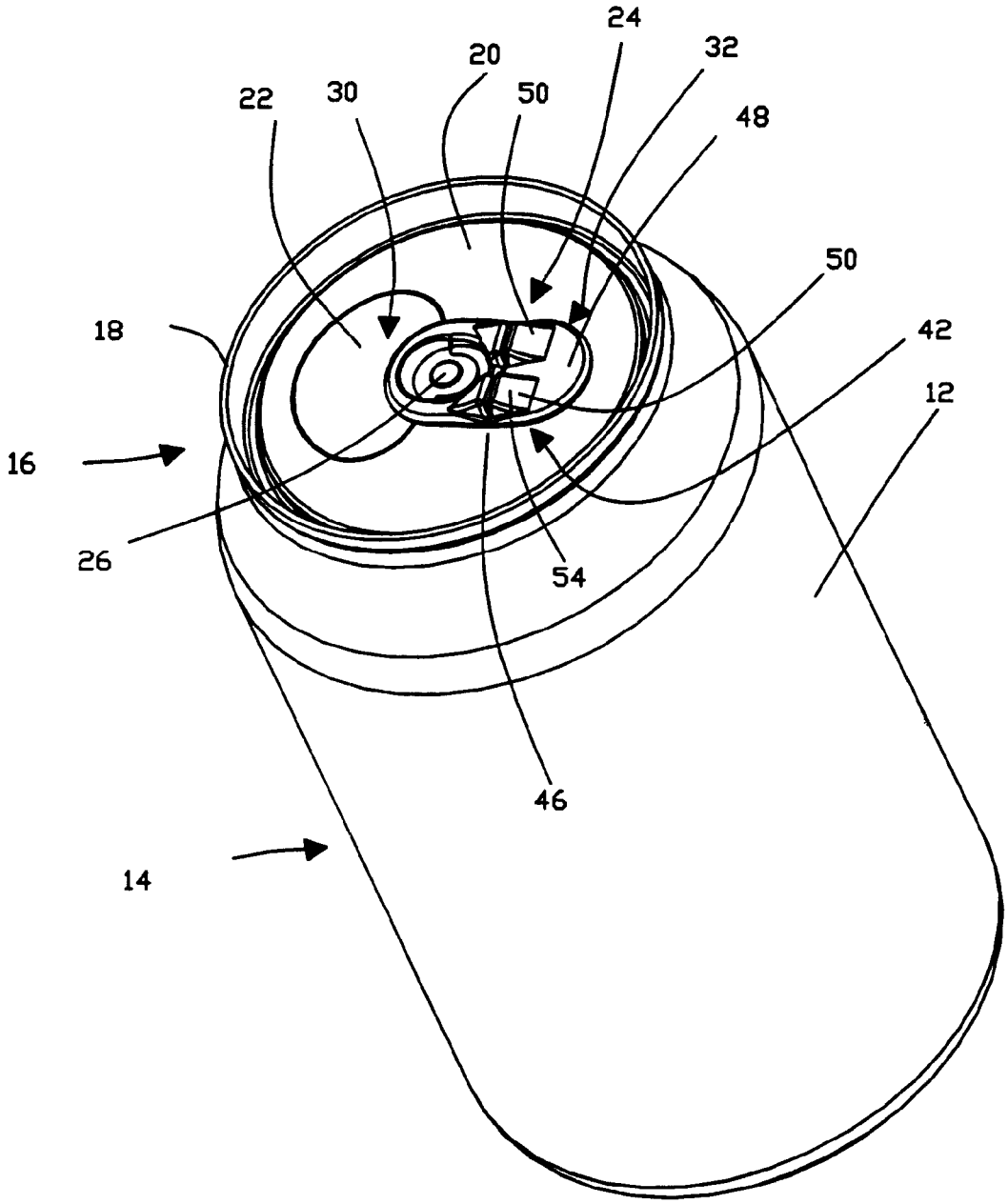
FIG. 1 is a perspective view of a typical aluminum beverage can having the pull tab opener of the present invention in place on the top surface thereof.
Figure 2:
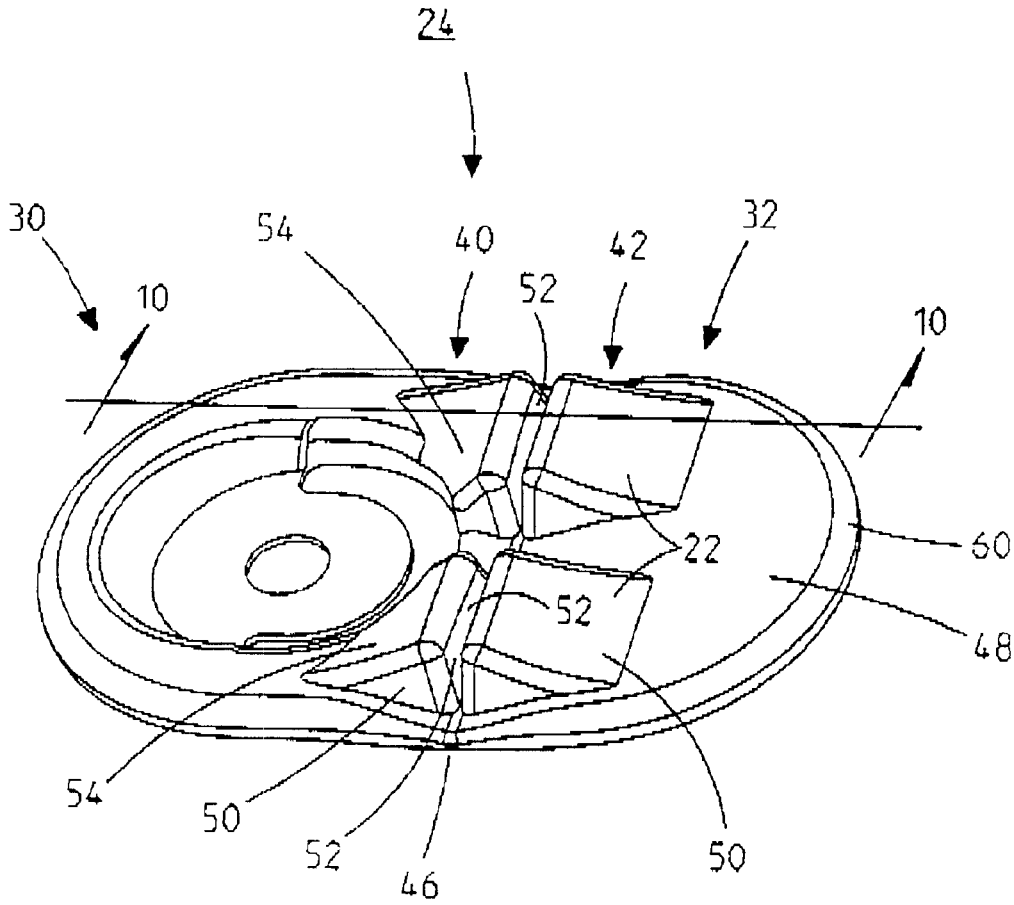
FIG. 2 is a greatly enlarged perspective view of a particular embodiment of the pull tab of the present invention.

Typically, a container 12 may be such as an aluminum beverage can of the sort shown in FIG. 1. It comprises a generally cylindrical major body portion 14, a neck portion 16, a rim 18, a top surface 20 having a frangible push-in closure 22 formed therein, and a pull tab 24. As is well know, the rim 18 is seamed to the container 12 in the upper region of the neck portion 16, after the container 12 has been filled with whatever beverage or other liquid is to be placed therein.

Also, as is well, known, the frangible push in closure 22 is such that it is partially severable from the top surface 20, so that when the pull tab opener 24 is operated the frangible push-in closure 22 will be levered downwardly into the interior of the container 12.

The pull tab opener 24 is secured to the top surface 20 of the container 12 by a rivet 26, which is placed near the frangible push-in closure. Typically, the rivet 26 is substantially centrally located, but not necessarily, on the top surface 20.

The pull tab opener 24 comprises a nose portion 30, and a tail portion 32. As can be readily seen in each of the figures except FIG. 2, at least a portion of the nose portion 30 of the pull tab opener 24 overlies at least a portion of the frangible push-in closure 22.

It is also evident that the rivet 26 is positioned between the nose portion 30 and the tail portion 32 of the pull tab opener 24.

As will be described hereafter, the tail portion 32 of the pull tab opener 24 is articulable. It comprises a front lever portion 40 and a rear lift lever portion 42. The front lever portion 40 lies in the same plane, and is an extension of, the nose portion 30 of the lift tab opener 24. The rear lift lever portion 42 is articulably joined to the front lever portion 40 at a crease line 46.

The tail portion comprises a base portion 48, and at least one pair of protrusions 50 which are upstanding therefrom. Typically, there are four protrusions 50, arranged as is shown in FIGS. 1 and 2; but it will be evident that only a single pair of protrusions which may be more centrally located on the base portion 48 may also be provided.

In any event, at least one of each pair of protrusions 50 is located at each side of the crease line 46.

Each of the protrusions 50 has a front face 52 (see FIG. 2), which is subtended by and extends upwardly from the crease line 46. Each of the front faces 52 is rectangular in shape; and it will be seen particularly from FIGS. 1 and 2, and it is clearly shown in each of the remaining FIGS. 3 through 9, that the front faces 52 of opposed pairs of protrusions 50 are opposed to each other.

Each of the protrusions 50 has a sloped rear surface 54, which extends downwardly from the top edge of the respective front face 52 towards the base portion 48, in a direction away from the crease line 46. This arrangement is clearly shown in each of the Figures.

Typically, the angle which is formed between the opposed pair of front faces 52 of each opposed pair of protrusions 50, is in the range of from 10° to 50°.

Figure 6:
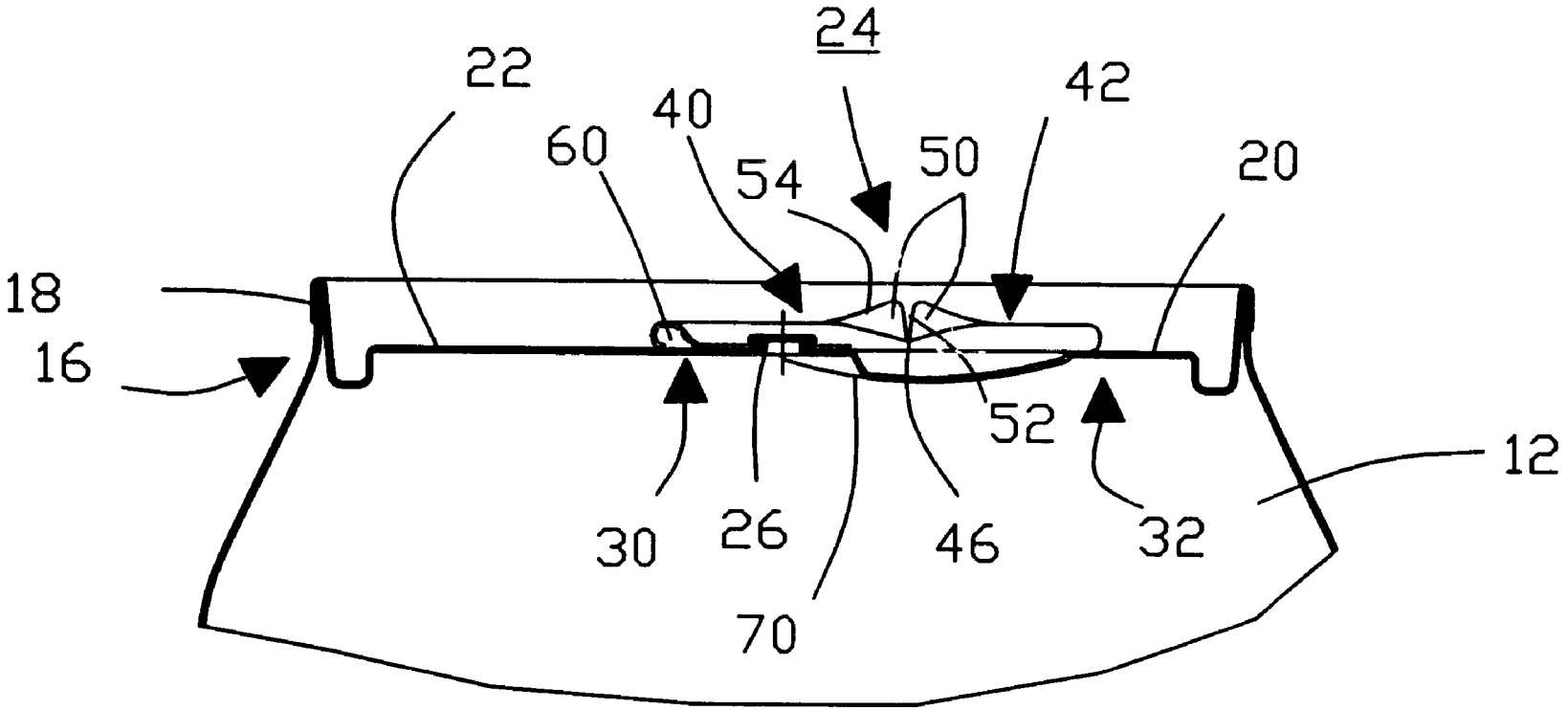
FIG. 6 is a view similar to FIG. 3, but of another embodiment in keeping with the present invention where a depression is formed in the top surface of the container.

Typically, the perimeter of the pull tab opener 24 is formed so as to have a tubular configuration as shown at 60 in FIGS. 2 and 6, for example. However, as will be evident from each of the figures of drawings, the tubular configuration at the perimeter of the pull tab opener 24 extends above the base portion 48 except in the region at each end of the crease line 46.

Figure 3:
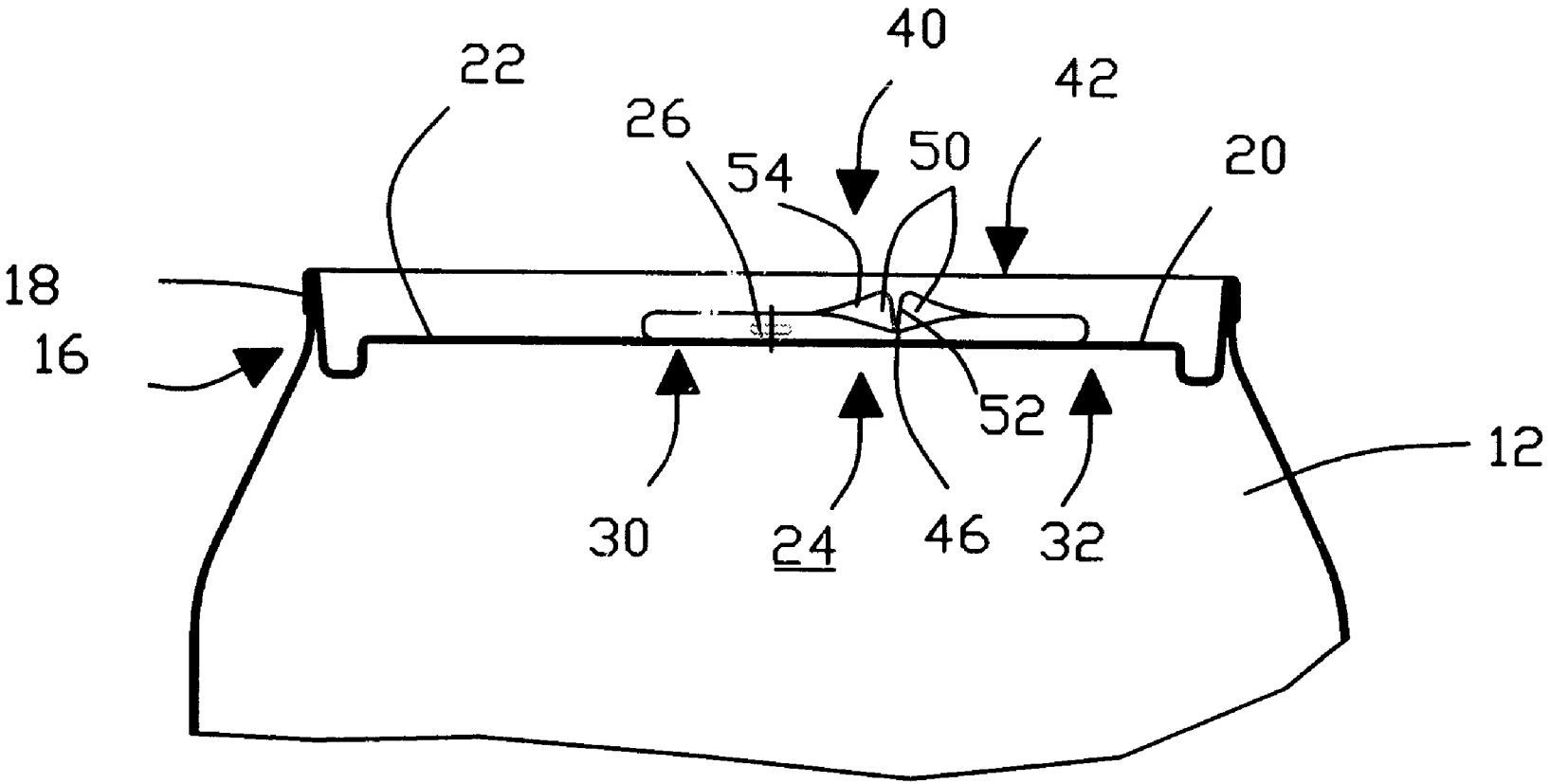
FIG. 3 is a side cross-section showing the pull tab in place on the top surface of a container.
Figure 4:
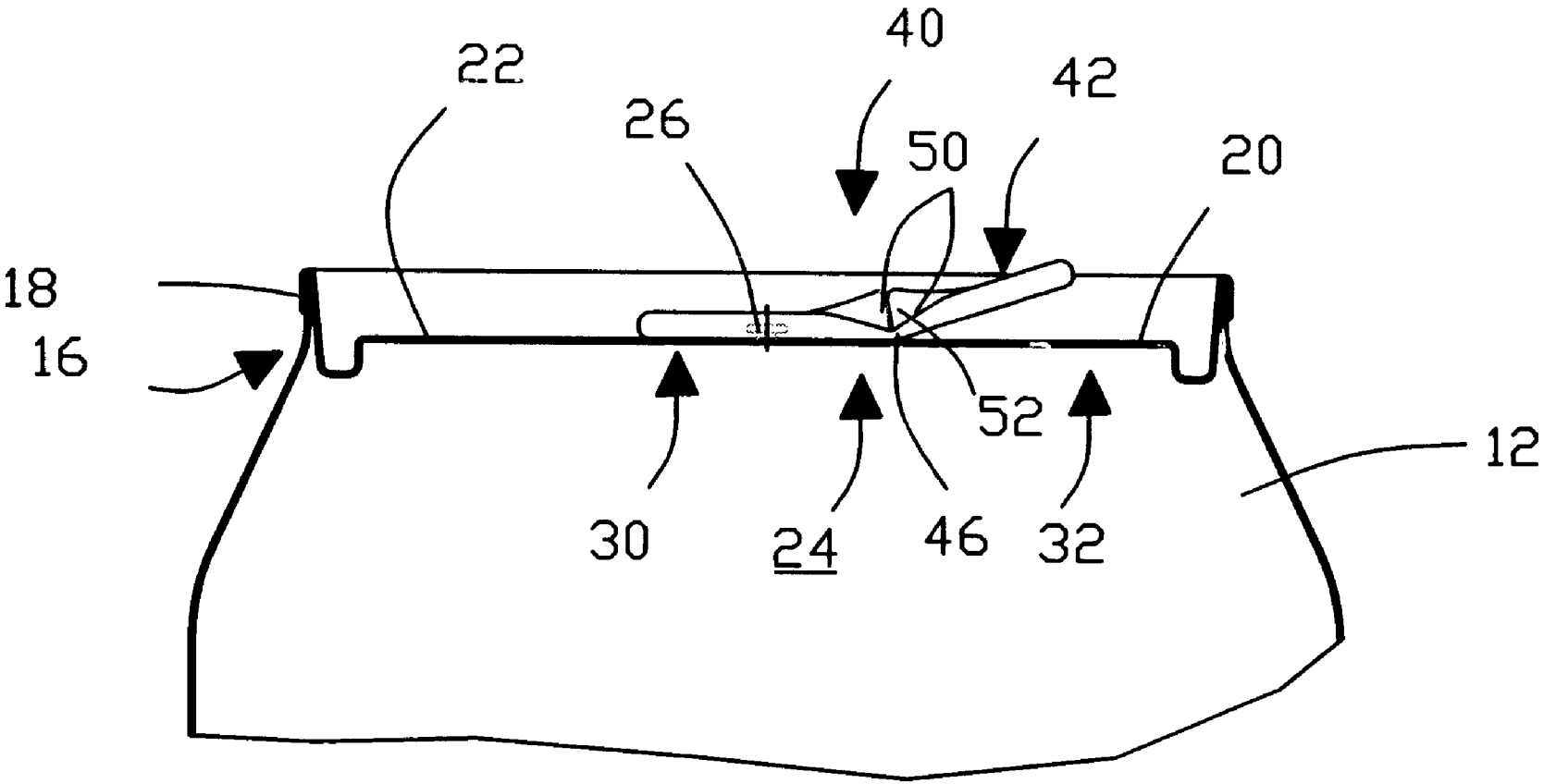
FIG. 4 is a view similar to FIG. 3, but showing the pull tab in an articulated condition.
Figure 5:
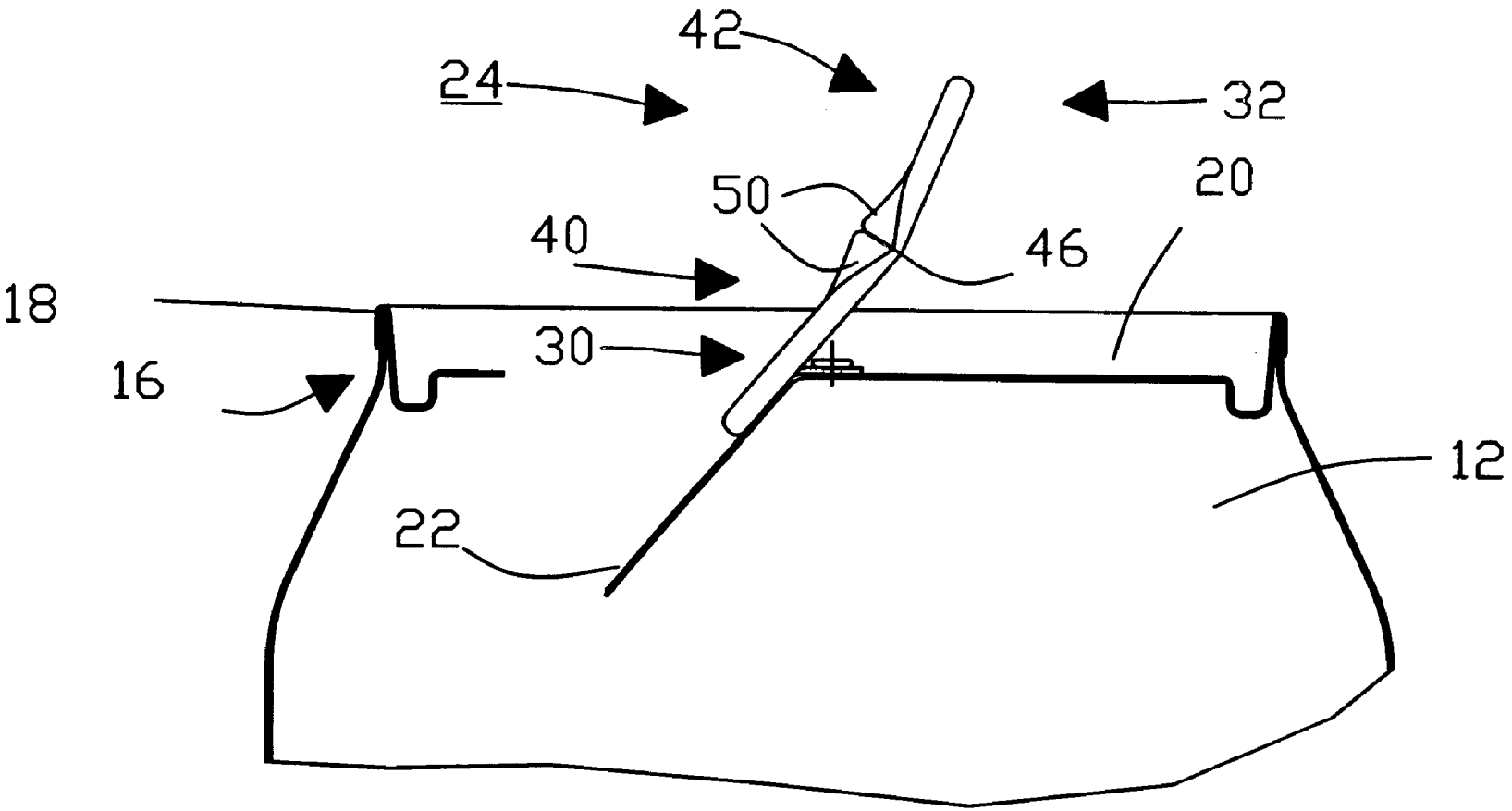
FIG. 5 is a view similar to FIGS. 3 and 4, but showing the articulated pull tab in a further position where the push-in closure of the container has been opened.

It will now be seen that operation of the pull tab opener of the present invention is easily effected in the manner shown in FIGS. 3 through 5, for example. However, to greater understand the operation, it should be noted that the elastic memory of the material of the pull tab opener 24, at least in the region of the crease line 46, is such that when the rear lever portion 42 has been pivoted about the crease line 46 so as to bring the opposed front faces 52 of protrusions 50 into contact one with the other, the elastic memory is overcome. Thus, the rear lift lever portion 42 is articulated to a new rest position relative to the front lever portion. This is clearly indicated by examination of FIGS. 3 and 4. Continued lifting action against the underside of the rear lift lever portion 42 will bring the front lever portion 40 and the nose portion 30 of the pull tab opener 24 into play, causing the frangible push-in closure 22 to break at its periphery and to extend downwardly into the interior of the container 12, as shown in FIG. 5.

Each of the FIGS. 1 to 9 illustrates the height of the apex which is formed between the front faces 52 and the sloped rear surfaces 54 of each of the protrusions 50 as being greater in height above the base portion 48 than the height of the tubular perimeter 60 is above the base portion 48. However, it will be evident from FIGS. 10 and 11 that the height at which the apex between the front faces 52 and the rear sloped surfaces 54 may be higher or lower than the height of the tubular perimeter 60. Thus, specific seaming equipment can be accommodated by appropriate adjustment of the precise design of the protrusions of the pull tab opener 24.

Figure 10:
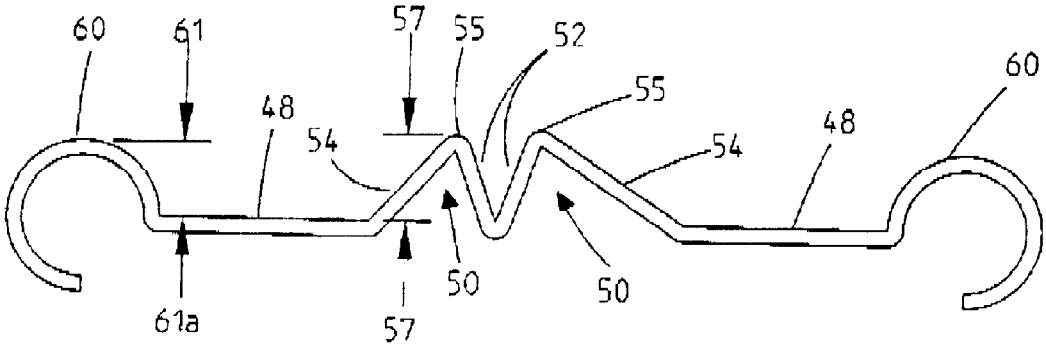
FIG. 10 is a cross-section taken in the direction of arrows 10—10 in FIG. 2.
Figure 11:
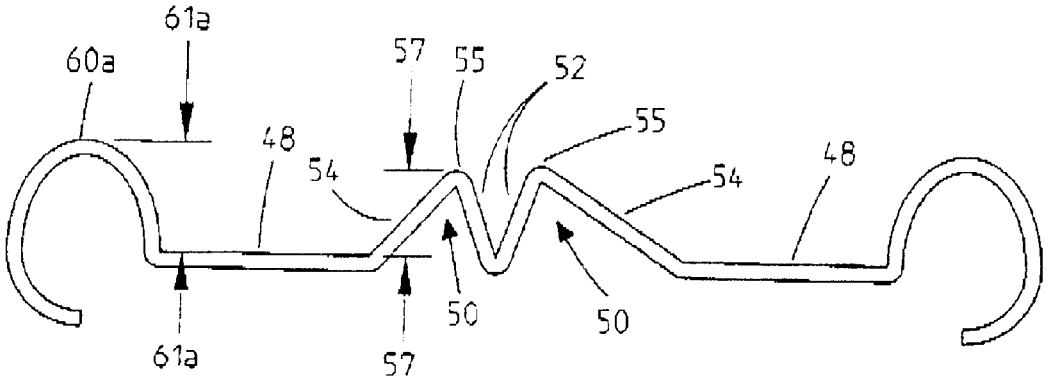
FIG. 11 is a view similar to FIG. 10, but of an alternative embodiment.

Specifically, as seen in FIG. 10, the height of the apex 55 between faces 54 and 52 of each protrusion 50 as shown by arrows 57—57, may be greater than the height of the tubular perimeter 60 above base portion 48, as shown by arrows 61—61. However, as seen in FIG. 11, the size of the tubular perimeter 60*a*, relative to the protrusions 50, may be such that its height above base portion 48 is greater than that of the apex 55, as shown by arrows 61*a*—61*a* relative to arrows 57—57.

As remarked previously, it is evident that the resistance against bending by the material of the pull tab opener 24 in the region of the crease line 46 is relatively low, so that little effort is required to lift the rear end of the rear lift lever portion 42 away from the top surface 20, from the position as shown in FIG. 3. It is simply a matter of hooking the fingernail underneath the end of the rear lift lever portion 42, and lifting gently upwardly until the position shown in FIG. 4 is attained. At that time, as noted, the elastic memory of the material will have been overcome, so that the rear lift lever portion has been articulated to a new rest position, relative to the front lever portion 40.

Then, it is simply a matter of effectively pinching the rear lift lever portion 42 of the pull tab opener 24 between the thumb and finger on the top and bottom surfaces, respectively, of the rear lift lever portion 42, and continuing on with the opening procedure to break and turn down the frangible push-in closure 22.

The presence of a finger hole through which at least a portion of the finger might extend or protrude is elective, at least in part depending on the nature of the beverage contained in the container 12. For example, a small finger opening might be placed in the region of the base portion 48 of the rear lift lever portion 42 on pull tab openers 24 that are placed onto containers in which juices or soft drinks that are to be consumed by young people are to be packaged. Such people might have slightly weaker hands, and require a bit more purchase on the tab. On the other hand, pull tab closures in keeping with the present invention which are intended to be placed on beverage containers for beer, which will be consumed in any event by an adult, do not necessarily require a finger opening.

Gripping of the pull tab opener 24 may also be facilitated by the provision of ridges, holes, dimples, and the like, which may be stamped into the base portion 48 of the rear lift lever portion 42.

Moreover, a particular embodiment of the present invention contemplates that the material of the base portion 48 of the lift tab pull tab opener of the present invention may be stamped in the region of the crease line 46. This causes a more reduced thickness, so that the material at that point may in fact be thinner than the stock material from which the pull tab opener 24 has been manufactured. This, in turn, may decrease the resistance against bending even further, making the pull tab opener more supple in the region of the crease line 46.

Still further, it should be pointed out that because of the suppleness of the material of the pull tab 24 in the region of the crease line 46, whether or not the crease line has been stamped as discussed immediately above, there is much less risk to the finger nail of the user in the instances where the nail is inserted beneath the outer end of the pull tab 24.

Another embodiment of the present invention is shown in FIGS. 6 through 9. Here, a depression 70 is formed in the top surface 20 of the container, in a region thereof which is below the tail portion 32 of the pull tab opener 24. Obviously, as can be seen particularly in any of FIGS. 6 through 8, the crease line 46 overlies the depression 70, and the length of the depression 70 is less than the length of the tail portion 32 of the pull tab opener 24.

Figure 7:
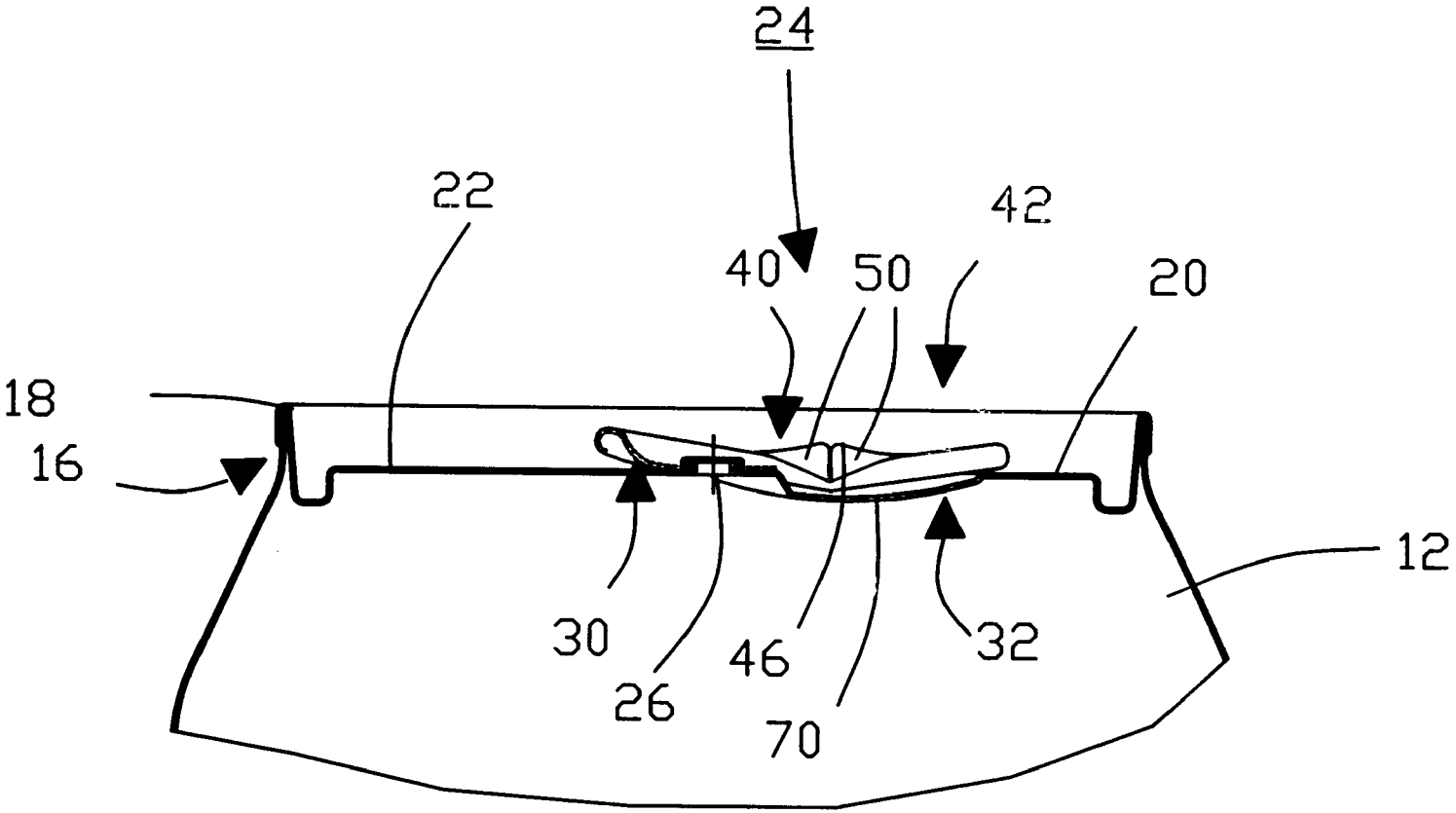
FIG. 7 shows the articulated pull tab opener having been articulated and pushed downwardly into the depression.
Figure 8:
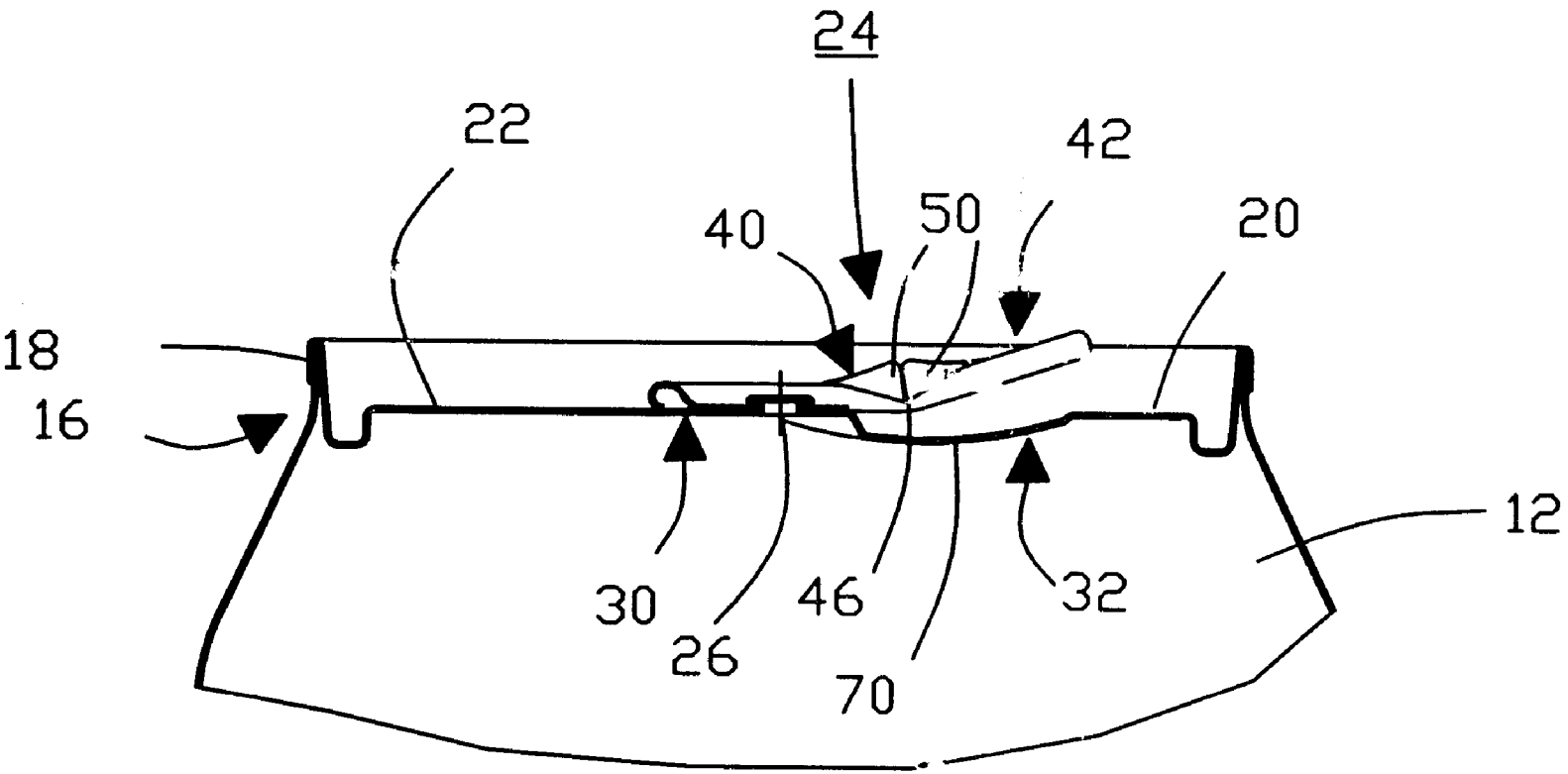
FIG. 8 is a view similar to FIG. 4, but of the embodiment of FIG. 6.
Figure 9:
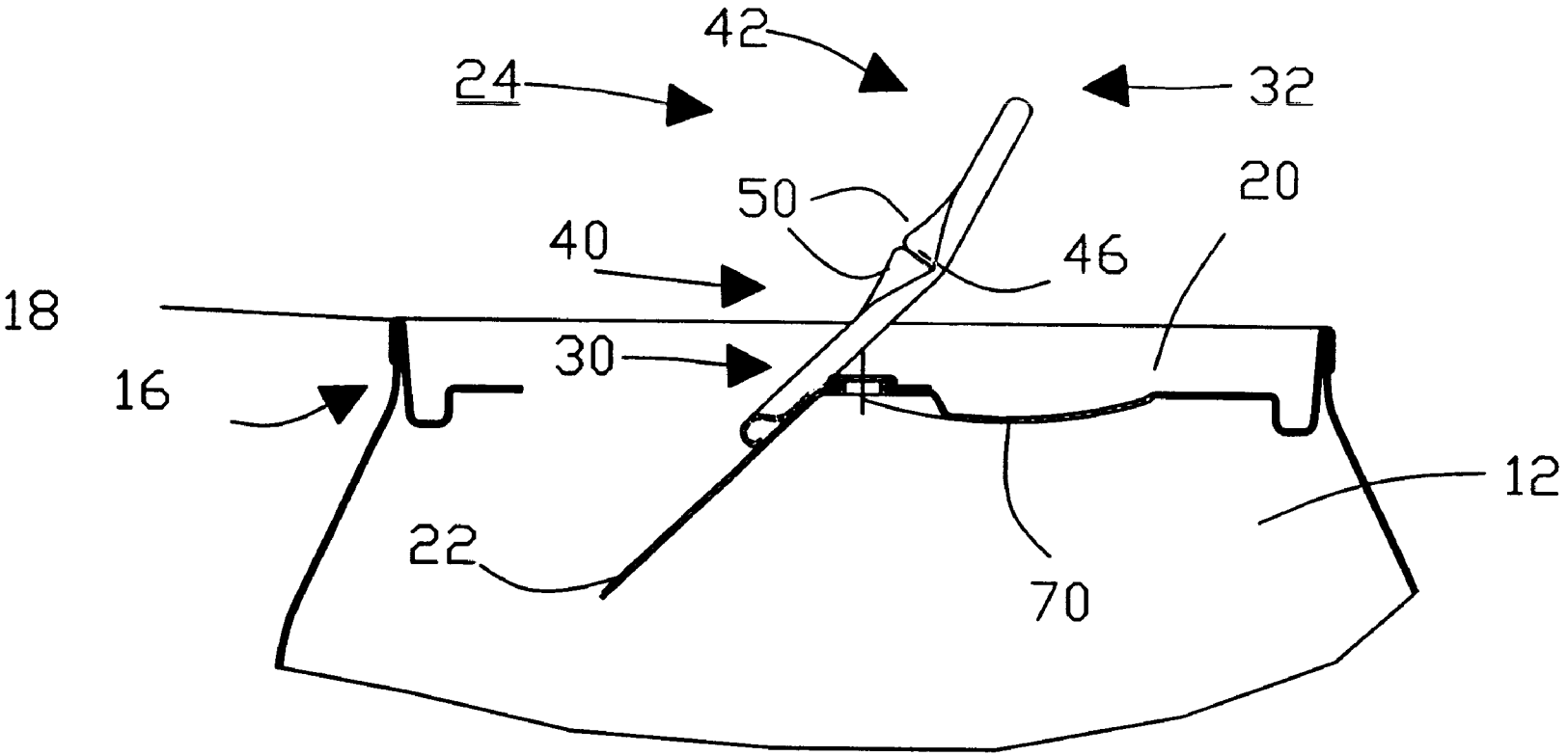
FIG. 9 is a view similar to FIG. 5, but of the embodiment of FIG. 6.

As can be seen particularly by examination of FIGS. 6 through 8, a sequence of events is shown whereby the tail portion 32 of the pull tab opener 24 has been pushed downwardly—such as by pushing against one or more of the protrusions 50. This permits the crease line 46 to enter into the depression 70. Also, the rear lift lever portion 42 is pivoted about the crease line 46 to the extent that the opposed front faces 52 of the protrusions 50 are brought into contact one with the other, as shown in FIG. 7. Moreover, the elastic memory of the material of the pull tab opener 24 in the region of the crease line 46 has been overcome so that, as shown in FIG. 8, the rear lift lever portion 42 has been articulated to a new rest position relative to the front lever portion 40.

However, it should be noted that the flexibility of the material of the lid of the container is such that there is no permanent deformation of the material in the region of the rivet 26.

It should also be noted that the depression 70 may also serve to resist buckling of the lid of the container 12 when it is under pressure from the beverage which is contained in the container 12.

A further embodiment of the present invention may contemplate the addition of a further pair of protrusions on the underside of the pull tab to force the articulation of the tab when pushed downwardly from above.

Still further, it may be noted that, in some cases, where there are two protrusions at each side of the crease line, one pair of protrusions at one side of the crease line can be replaced with a single, long protrusion.

It should also be noted that pull tab openers as described herein may be used with lids for cans, such as food cans and the like, where the lid is entirely removed from the can. The principal of operation is much the same; first, a levering action is made against the material of the lid at the nose portion so as to break the seal, but then the lid is removed by pulling the tab so as to remove the lid.

There has been described a beverage container which has a particular pull tab opener affixed to the lid of the container, with the configuration of the pull tab opener being such that it may be articulated into a position from whence an easy levering action of the nose portion of the pull tab closer against the frangible push-in closure in the top surface of the container may be effected. However, when manufactured and placed on the lid of the container, the positioning, size, and height of the pull tab opener of the present invention emulates those which are presently found in the market. This assures their easy adaptation to currently used filling and seaming machines of the sort found particularly in the beverage industries of all kinds.

Other modifications and alterations may be used in the design and manufacture of the apparatus of the present invention without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

What is claimed is:

1. A container and pull tab opener therefor; where said container has a top surface having a frangible push-in closure therein which is partially severable from said top surface, and where said pull tab opener is secured to said top surface near said frangible push-in closure;

wherein said pull tab opener comprises a nose portion and a tail portion;

wherein at least a portion of said nose portion overlies at least a portion of said frangible push-in closure; and wherein said pull tab opener is secured to said top surface at a position on said pull tab opener which is between said nose portion and said tail portion;

said tail portion being articulable, and having a front lever portion which lies in the same plane and is an extension of said nose portion, and a rear lift lever portion which is articulably joined to said front lever portion at a crease line;

said tail portion comprising a base portion and at least a pair of protrusions upstanding therefrom, wherein one of said at least a pair of protrusions is located at each side of said crease line;

wherein each of said protrusions has a front face which is subtended by and extends upwardly from said crease line, each of said front faces is rectangular in shape, and each of said front faces is opposed to the other of said front faces of said at least a pair of protrusions;

wherein each of said at least a pair of protrusions has a sloped rear surface extending downwardly from the top edge of the respective front face towards said base portion in a direction away from said crease line; and wherein the angle formed between said opposed pair of front faces is in the range of from 10° to 50°.

2. The combination of claim 1, wherein said pull tab opener is secured to said top surface by a rivet placed near said frangible push-in closure; and wherein said rivet is positioned between said nose position and said tail portion.

3. The combination of claim 1, wherein two pairs of opposed protrusions are arranged, with one of each of said pairs of opposed protrusions at each side of said crease line.

4. The combination of claim 1, wherein the perimeter of said pull tab opener is formed so as to have a tubular configuration, which extends above said base portions except in the region at each end of said crease line.

5. The combination of claim 4, wherein the height of the apex formed between the front face and the sloped rear surface of each of said at least a pair of protrusions above said base portion is not greater than the height of said tubular perimeter above said base portion.

6. The combination of claim 4, wherein the height of the apex formed between the front face and the sloped rear surface of each of said at least a pair of protrusions above said base portion is greater than the height of said tubular perimeter above said base portion.

7. The combination of claim 1, wherein the material of said base portion is stamped in the region of said crease line so as have a reduced thickness.

8. The combination of claim 1, further comprising a depression formed in said top surface in a region thereof below said tail portion;

wherein said crease line overlies said depression, and the length of said depression is less than the length of said tail portion.

9. The combination of claim 1, wherein an elastic memory of the material of said pull tab opener, in the region of said crease line, is such that when said rear lift lever portion is pivoted about said crease line so as to bring said opposed front faces of said at least a pair of protrusions into contact one with the other, said elastic memory is overcome and said rear lift lever portion is articulated to a new rest position relative to said front lever portion.

10. The combination of claim 8, wherein an elastic memory of the material of said pull tab opener, in the region of said crease line, and the depth of said depression, is such that when said tail portion is pushed downwardly so as to permit said crease line to enter into said depression, and so that said rear lift lever portion is pivoted about said crease line, to the extent that said opposed front faces of said at least a pair of protrusions are brought into contact one with the other, said elastic memory is overcome and said rear lift lever portion is articulated to a new rest position relative to said front lever portion.

11. A container and pull tab opener therefore, where said container has a top surface which comprises a frangible lid which is fully severable away from said container, and where said pull tab opener is secured to said top surface near a portion of the frangible perimeter thereof;

wherein said pull tab opener comprises a nose portion and a tail portion;

wherein said nose portion is located in close proximity to the frangible perimeter of said lid; and wherein said pull tab opener is secured to said lid at a position on said pull tab opener which is between said nose portion and said tail portion;

said tail portion being articulable, and having a front lever portion which lies in the same plane and is an extension of said nose portion, and a rear lift lever portion which is articulably joined to said front lever portion at a crease line;

said tail portion comprising a base portion and at least a pair of protrusions upstanding therefrom, wherein one of said at least a pair of protrusions is located at each side of said crease line;

wherein each of said protrusions has a front face which is subtended by and extends upwardly from said crease line, each of said front faces is rectangular in shape, and each of said front faces is opposed to the other of said front faces of said at least a pair of protrusions;

wherein each of said at least a pair of protrusions has a sloped rear surface extending downwardly from the top edge of the respective front face towards said base portion in a direction away from said crease line; and wherein the angle formed between said opposed pair of front faces is in the range of from 10° to 50°.

12. The combination of claim 11, where in said pull tab opener is secured to said lid by a rivet; and wherein said rivet is positioned between said nose portion and said tail portion.

13. The combination of claim 11, wherein two pairs of opposed protrusions are arranged, with one of each said pairs of opposed protrusions at each side of said crease line.

14. The combination of claim 11, wherein the perimeter of said pull tab opener is formed so as to have a tubular configuration, which extends above said base portions except in the region at each end of said crease line.

15. The combination of claim 14, wherein the height of the apex formed between the front face and the sloped rear surface of each of said at least a pair of protrusions above said base portion is not greater than the height of said tubular perimeter above said base portion.

16. The combination of claim 14, wherein the height of the apex formed between the front face and the sloped rear surface of each of said at least a pair of protrusions above said base portion is greater than the height of said tubular perimeter above said base portion.

17. The combination if claim 11, wherein the material of said base portion is stamped in the region of said crease line so as to have a reduced thickness.

18. The combination of claim 11, further comprising a depression formed in said top surface in a region thereof below said tail portion;

wherein said crease line overlies said depression, and the length of said depression is less than the length of said tail portion.

19. The combination of claim 11, wherein an elastic memory of the material of said pull tab opener, in the region of said crease line, is such that when said rear lift lever portion is pivoted about said crease line so as to bring said opposed front faces of said at least a pair of protrusions into contact one with the other, said elastic memory is overcome and said rear lift lever portion is articulated to a new rest position relative to said front lever portion.

20. The combination of claim 18, wherein an elastic memory of the material of said pull tab opener, in the region of said crease line, and the depth of said depression, is such that when said tail portion is pushed downwardly so as to permit said crease line to enter into said depression, and so that said rear lift lever portion is pivoted about said crease line, to extent that said opposed front faces of said at least a pair of protrusions are brought into contact one with the other, said elastic memory is overcome and said rear lift portion is articulated to a new rest position relative to said front lever portion.

* * * * *